United States Patent [19]

Beyer et al.

[11] 4,011,054

[45] Mar. 8, 1977

[54] SINTER MATERIAL FOR SEALING STRIPS IN ROTARY PISTON ENGINES

[75] Inventors: Horst Beyer, Burscheid; Ulrich Buran, Opladen-Quettingen; Norbert Dautzenberg, Meerbusch; Joseph Hewing, Monchengladbach, all of Germany

[73] Assignee: Goetzewerke-Friedrich Goetze AG, Burscheid, Germany

[22] Filed: Sept. 9, 1976

[21] Appl. No.: 721,716

Related U.S. Application Data

[63] Continuation of Ser. No. 424,802, Dec. 14, 1973, abandoned.

[30] Foreign Application Priority Data

Dec. 16, 1972 Germany ..... 2261794

[52] U.S. Cl. ..... 29/182.7; 29/182.8; 75/.5 BC

[51] Int. Cl.[2] ..... C22C 1/10

[58] Field of Search ..... 75/.5 R, .5 BC, .5 AC; 29/182.7, 182.8

[56] References Cited

UNITED STATES PATENTS 2,791,025 5/1957 Ballhausen ..... 29/182.7

*Primary Examiner*—Arthur J. Steiner
*Attorney, Agent, or Firm*—Spencer & Kaye

[57] ABSTRACT

A sinterable material for use as sealing strips for rotary piston engines, the material being based on a known mixture of iron and vanadium carbide and further including a material which will be liquid at the sintering temperature and which will wet the carbide grains and partially dissolve them to give them a rounded form in the finished strip.

15 Claims, No Drawings

SINTER MATERIAL FOR SEALING STRIPS IN ROTARY PISTON ENGINES

CROSS-REFERENCE TO RELATED APPLICATION

This application is a continuation of copending Application Ser. No. 424,802, filed December 14th, 1973, now abandoned.

BACKGROUND OF THE INVENTION

The present invention relates to a sinter material composed of a powder mixture of vanadium carbide and iron, particularly for use as sealing strips for rotary piston engines.

Sealing strips in pistons for rotary piston engines are subjected to rapid wear due to the very high operating pressures and temperatures, high relative speeds between sliding parts, difficult or insufficient lubrication between the contacting surfaces, and the abrasiveness of the countersurface which usually consists of an electrodeposited nickel layer with embedded silicon carbide.

Very hard materials are known which meet these requirements regarding wear. However, the particles in the matrix of these materials have poor stability. These particles are subject to wear and their unfavorable grain configuration causes the particles to break out during operation of the rotary piston engines. These particles then cause an abrasive action between the sealing strip and the countersurface, with the result that more particles break out and the wear is accelerated more and more.

On the other hand, ceramic oxide materials are known whose particle stability and wear resistance are very good. However, the tensile strength of sealing strips made of these materials is poor. As a result, the sealing strips often break through operation of the rotary piston engine, in which case, the operational dependability of the sealing strips of such engines would be no longer assured.

It presently appears that rotary piston engines will be used increasingly in automotive vehicles. Thesefore, any improvement in the operating reliability and durability of these engines represents a great benefit to the motoring public.

SUMMARY OF THE INVENTION

It is therefore an object of the present invention to provide a material which can be made into sealing strips, for rotary piston engines, that have good wear resistance combined with excellent sliding behavior against nickel and a high tensile strength.

These and other objects are achieved according to the present invention by the provision of a sinter material based on a known powder mixture of iron or an iron alloy and vanadium carbide or vanadium carbide mixed with other carbides, as disclosed, for example, in German Pat. No. 659,534 and German Pat. No. 764,144. The material according to the present invention further includes powdered additives which are in the liquid phase at the sintering temperature. The material according to the invention can be pressed, or otherwise formed, and sintered in the usual manner.

DESCRIPTION OF THE PREFERRED EMBODIMENTS

Sinter material according to the invention is characterized in that the additive is of a composition which in the liquid state thoroughly wets the vanadium carbide during the sintering process and simultaneously modifies it by partially dissolving it. Such additive may be, for example, constituted by one of the following compounds or alloys: Fe-B, Ni-Mn-B, V-Al, Cu-Mn and/or $Cu_3P$.

It has been found that the partial dissolution process occurring during sintering of a composition according to the invention causes the originally sharp-edged vanadium carbide crystals to be changed into rounded grains. Thus, in an engine operating with a sealing strip according to the invention, there are no sharp-edged vanadium carbide crystals to attack the countersurface and wear is reduced substantially. The accelerated wear or abrasion previously observed with other materials becomes impossible.

At the same time, a composition which is liquid at the sintering temperature better wets the individual vanadium carbide particles. As a result, the particles are more firmly incorporated into the matrix and individual carbide bodies no longer break out to produce the annoying abrasive wear between the sealing strip and the trochoidal countersurface.

Additionally, the incorporation of such substances also improves the stability and, in particular, the breaking and bending strength of the sealing ledge, eliminating one source of adverse influence on the operational dependability of a rotary piston engine.

It has been found that the best sealing strip characteristics are obtained with materials according to the invention in which the carbide component concentration is 15 to 45 percent, by weight. If the carbide proportion is increased beyond this value, the liquid phases, at the sintering temperature, no longer wet all grains so that not all of the carbide crystals are converted to a rounded grain form and annoying particle break-outs will occur. In addition, the flexure strength of the material decreases above this value.

If, however, the carbide content drops below 15 percent by weight, the wear resistance is reduced and the substance, particularly when the carbide proportion is less than 3 percent by weight, can no longer be used as a material for sealing strips.

In our experiments, a sintered alloy containing 22 percent by weight vanadium carbide, 4 percent by weight of material which will be in the liquid phase at sintering temperature, and the remainder iron has been found to be particularly suitable. In one version, 74 parts of iron powder, 22 parts of VC and 4 parts Ni-Mn-B are taken and thoroughly mixed in a milling process. The mixture is placed in a mold, the size of an apex seal and compressed under a pressure of 8 metric tons/cm$^2$. This is followed by sintering for 1 hour at 120° C in an atmosphere of hydrogen.

In order to increase the wear resistance of the metallic matrix, one or a plurality of elements contributing to the hardening of the material, such as, for example, the metals chromium, molybdenum, vanadium and/or titanium may be present in the powder mixture. It is unimportant whether these metals are already alloyed to the iron powder or are added individually or together to the powder mixture in powdered form.

Instead of vanadium carbide, it is also possible to use mixtures of carbides of vanadium with, for example, carbides of tungsten, molybdenum, chromium, titanium or zirconium.

Apex seals are manufactured by the above-described process from sinter metals with the following compositions:

1. 75 parts of an iron powder containing 3.2% by weight of C, 2.4% by weight of Si, 2.4% by weight of Cr and 4.8% by weight of Mo; 22 parts VC and 3 parts Ni—Mn—B;

2. 75 parts of an iron powder with 3.2% by weight C, 2.4% by weight Si, 2.4% by weight Cr and 4.8% by weight Mo; 22 parts carbide with 50% VC and 50% WC and 3 parts Ni—Mn—B;

3. 65 parts of an iron powder with 3.1% by weight C, 1.8% by weight Si, 4% by weight W and 4% by weight Cr; 30 parts VC and 5 parts Ni—Mn—B;

4. 55 parts iron powder with 3.1% C, 1.8% by weight Si, 4% by weight W and 4% by weight Cr; 40 parts VC and 5 parts Ni—Mn–B.

It will be understood that the above description of the present invention is susceptible to various modifications, changes and adaptations, and the same are intended to be comprehended within the meaning and range of equivalents of the appended claims.

What is claimed is:

1. In a sintered material for a sealing strip of a rotary piston engine and produced from a powder mixture of 15 to 45 weight percent of vanadium carbide or a mixture of vanadium carbide with at least one other metal carbide and balance essentially iron or an iron alloy, the improvement wherein the powder mixture further comprises at least one additive selected from the group consisting of (1) the compound $Cu_3P$, (2) an alloy of the system Fe—B, (3) an alloy of the system Cu-Mn, and (4) an alloy of the system Ni—Mn—B, the amount of said additives (1), (2) and (3) when present being 4 weight percent and the amount of said additive (4) when present being 3 to 5 weight percent, said additive being liquid at the material sintering temperature and being effective to wet and partially dissolve the vanadium carbide during the sintering process and prevent the vanadium carbide from breaking out of the sintered material.

2. Sintered material as defined in claim 1, wherein the vanadium carbide is present in a mixture with a carbide of at least one of tungsten, molybdenum, chromium, zirconium, and titanium.

3. Sintered material as defined in claim 1, wherein the powder mixture further includes chromium, molybdenum, vanadium and/or titanium.

4. Sintered material as defined in claim 1, wherein said additive is present in an amount of 4 percent by weight.

5. Sintered material as defined in claim 1, wherein said additive comprises 3 to 5 weight percent of Ni—Mn—B.

6. Sintered material as defined in claim 1, wherein said powder mixture comprises 22 weight percent vanadium carbide, 74 weight percent iron powder, and 4 weight percent of said additive.

7. Sintered material as defined in claim 1, wherein said powder mixture comprises 75 weight percent of iron powder, 22 weight percent vanadium carbide, and 3 weight percent Ni-Mn-B.

8. Sintered material as defined in claim 7, wherein said iron powder includes 2.4 percent chromium and 4.8 weight percent molybdenum.

9. Sintered material as defined in claim 1, wherein said powder mixture comprises 75 weight percent iron powder, 22 weight percent of a mixture containing 50 parts by weight vanadium carbide and 50 parts by weight tungsten carbide, and 3 weight percent Ni—Mn—B.

10. Sintered material as defined in claim 9, wherein said iron powder includes 2.4 weight percent chromium and 4.8 weight percent molybdenum.

11. Sintered material as defined in claim 1, wherein said powder mixture comprises 65 weight percent iron powder, 30 weight percent vanadium carbide, and 5 weight percent Ni—Mn—B.

12. Sintered material as defined in claim 11, wherein said iron powder includes 4 weight percent chromium and 4 weight percent tungsten.

13. Sintered material as defined in claim 1, wherein said powder mixture comprises 55 weight percent iron powder, 40 weight percent vanadium carbide and 5 weight percent Ni-Mn-B.

14. Sintered material as defined in claim 13, wherein said iron powder includes 4 weight percent chromium and 4 weight percent tungsten.

15. Sintered material as defined in claim 1, wherein said powder mixture comprises 55 to 75 weight percent iron powder, 11 to 40 weight percent vanadium carbide and 3 to 5 weight percent Ni—Mn—B.

* * * * *